US012038022B2

(12) United States Patent
Zhang et al.

(10) Patent No.: US 12,038,022 B2
(45) Date of Patent: Jul. 16, 2024

(54) SELF-PRIMING JET PUMP

(71) Applicant: NINGBO JUNHE INTELLIGENT TECHNOLOGY CO., LTD, Ningbo (CN)

(72) Inventors: Junbo Zhang, Ningbo (CN); Ke Yang, Ningbo (CN); Hailiang Xu, Ningbo (CN); Junwei Bao, Ningbo (CN); Libing Hong, Ningbo (CN)

(73) Assignee: NINGBO JUNHE INTELLIGENT TECHNOLOGY CO., LTD, Ningbo (CN)

( * ) Notice: Subject to any disclaimer, the term of this patent is extended or adjusted under 35 U.S.C. 154(b) by 0 days.

(21) Appl. No.: 17/975,643

(22) Filed: Oct. 28, 2022

(65) Prior Publication Data

US 2023/0400027 A1 Dec. 14, 2023

Related U.S. Application Data

(63) Continuation-in-part of application No. PCT/CN2022/102110, filed on Jun. 29, 2022.

(30) Foreign Application Priority Data

Jun. 9, 2022 (CN) ..... 202210646174.X

(51) Int. Cl.
*F04D 9/06* (2006.01)
*F04D 9/02* (2006.01)

(52) U.S. Cl.
CPC ..... *F04D 9/06* (2013.01); *F04D 9/02* (2013.01)

(58) Field of Classification Search
CPC ..... F04D 9/02; F04D 9/06; F04D 29/086; F04D 29/4213
See application file for complete search history.

(56) References Cited

U.S. PATENT DOCUMENTS 2,853,014 A * 9/1958 Carpenter ..... F04D 9/06 417/174
4,820,131 A * 4/1989 Johnson ..... F04D 29/426 417/89

(Continued)

FOREIGN PATENT DOCUMENTS

CN 101644272 A 2/2010
CN 202348688 U 7/2012

(Continued)

*Primary Examiner* — David E Sosnowski
*Assistant Examiner* — Jason G Davis
(74) *Attorney, Agent, or Firm* — Bayramoglu Law Offices LLC

(57) ABSTRACT

A self-priming jet pump includes a pump body provided with a water inlet and a water outlet. A jet tube and an impeller are arranged in the pump body. The jet tube is communicated with the water inlet and an inlet of an impeller. A first channel is arranged on the outer periphery of the jet tube. The first channel is communicated with the water inlet and the impeller. A cross-section of the first channel is a closed or open annular structure, and the first channel is around the outer periphery of the jet tube. The first channel is provided with a valve core. When a pressure at the water inlet is greater than a predetermined pressure at the impeller, the valve core moves to switch on the first channel. A cavitation problem is relieved by arranging the flow-increasing channel.

10 Claims, 5 Drawing Sheets

(56) References Cited

U.S. PATENT DOCUMENTS

| | | | | |
|---|---|---|---|---|
| 5,474,418 | A | 12/1995 | Wessel et al. | |
| 7,059,824 | B2 * | 6/2006 | Ramacciotti ..... | F04D 9/06 415/11 |
| 10,815,863 | B2 * | 10/2020 | Diekmann ..... | F01P 5/10 |
| 2007/0189908 | A1 | 8/2007 | Akiyama et al. | |

FOREIGN PATENT DOCUMENTS

| | | | |
|---|---|---|---|
| CN | 102734177 | A | 10/2012 |
| CN | 106194840 | A | 12/2016 |
| CN | 107269544 | A | 10/2017 |
| CN | 107740770 | A | 2/2018 |
| CN | 207297390 | U | 5/2018 |
| CN | 110067777 | A | 7/2019 |
| EP | 0645541 | A1 | 3/1995 |
| JP | 2000110797 | A | 4/2000 |
| RU | 2027911 | C1 | 1/1995 |
| RU | 2351805 | C1 | 4/2009 |
| RU | 2683062 | C1 | 3/2019 |

* cited by examiner

SELF-PRIMING JET PUMP

CROSS REFERENCE TO THE RELATED APPLICATIONS

This application is the continuation-in-part application of International Application No. PCT/CN2022/102110, filed on Jun. 29, 2022, which is based upon and claims priority to Chinese Patent Application No. 202210646174.X, filed on Jun. 9, 2022, the entire contents of which are incorporated herein by reference.

TECHNICAL FIELD

The present disclosure relates to the technical field of jet pumps and, in particular, to a self-priming jet pump.

BACKGROUND

A water pump is a device configured to convey liquid, including a motor and a pump body. The pump body is provided with a water inlet, a water inlet channel, a pressurizing chamber, a water outlet channel, and a water outlet. An impeller is arranged in the pressurizing chamber. The water inlet is connected to the water inlet channel. The water outlet is connected to the water outlet channel. The pressurizing chamber is connected to the water inlet channel and the water outlet channel, respectively. The motor drives the impeller to rotate at a high speed, and the external water flow passes through the water inlet and the water inlet channel in sequence to enter the pressurizing chamber. A high-pressure water flow is formed by the pressurization of the impeller, enters the water outlet channel, and then is discharged from the water outlet. With the continuous discharge of the fluid inside the impeller, a low-pressure area is gradually formed at the center of the impeller, and even a vacuum is reached. At this time, under the action of atmospheric pressure, the fluid at the inlet of the water pump continuously flows into the impeller through the water inlet and is thrown out by the impeller. In this process, the mechanical energy of the pump shaft is transmitted to the fluid by the impeller to form pressure energy and kinetic energy in the fluid, which are reflected as the lift output of the water pump.

Specifically, the performance of the water pump depends on two parameters, namely lift and flow. The curve relation between lift and flow is inversely proportional, that is, if the lift is high, then the flow is small, while if the lift is low, then the flow is large. The performance of the water pump degrades when a certain flow rate is reached. This effect is due to the formation of primary cavitation in the area around the jet nozzle at the opening of the venturi. It not only reduces the lift and efficiency of the water pump but also causes problems, such as vibration, noise, and cavitation.

In order to control cavitation or alleviate the damage caused by cavitation, the main measures currently taken are the optimization of the inlet of the pressurizing chamber, the optimization of the blade load, the installation of the inducer, the injection and pressurization of the inlet, and the adoption of the double suction structure to reduce the inlet flow rate of the pump and increase the inlet pressure of the pump to realize the control or alleviation of cavitation.

The Chinese patent application No. CN201910335203.9, entitled "FLOW-INCREASING WATER PUMP", discloses a pump body with a water inlet and a water outlet. A water inlet chamber, a pressurizing chamber, and a water flow channel are arranged in the pump body. The water inlet chamber and the pressurizing chamber are further communicated through a flow-increasing channel. A one-way check mechanism is arranged in the flow-increasing channel. When the liquid pressure in the water inlet chamber is higher than the liquid pressure in the pressurizing chamber, the one-way check mechanism switches on the flow-increasing channel. When the liquid pressure in the water inlet chamber is lower than the liquid pressure in the pressurizing chamber, the one-way check mechanism blocks the flow-increasing channel. According to the flow-increasing water pump patent, the structural design of the pump body is reasonably improved, the flow-increasing channel is additionally arranged between the water inlet chamber and the pressurizing chamber, and the flowing or blocking of the liquid flow in the flow-increasing channel is controlled according to the pressure change between the pressurizing chamber and the water inlet chamber in the pump body by means of the one-way check mechanism, such that the curve relation diagram of the flow and the lift of the water pump is optimized, and the performance of the water pump is significantly improved.

However, the above-mentioned patent application has the following problems: 1. The flow-increasing channel arranged on one side of the water inlet chamber and the pressurizing chamber has a very limited channel flow rate, and the optimization effect is not ideal without increasing the volume of the pump body. 2. The one-way check mechanism is arranged in the narrow flow-increasing channel. The one-way check mechanism includes a partition plate, a guide sleeve, a movable rod, a movable baffle, a compression spring, and others. The one-way check mechanism has a complex structure and a high production cost and is difficult to assemble and is easily damaged during use.

SUMMARY

A technical problem to be solved by the present disclosure is to provide a self-priming jet pump to relieve the cavitation problem by arranging a flow-increasing channel, which has a simple production process and a low production cost.

A technical solution adopted by the present disclosure is as follows: A self-priming jet pump includes a pump body provided with a water inlet and a water outlet. A jet tube and an impeller are arranged in the pump body. The jet tube is communicated with the water inlet and an inlet of an impeller. A first channel is arranged on the outer periphery of the jet tube. The first channel is communicated with the water inlet and the inlet of the impeller. The fluid passing through the jet tube or the first channel is thrown out by the impeller to enter a pressurizing chamber. The cross-section of the first channel is a closed or open annular structure. The first channel is around the outer periphery of the jet tube. The first channel is provided with a valve core.

Compared with the prior art, the present disclosure has the advantages that the first channel is arranged on the outer periphery of the jet tube, and the first channel is communicated with the water inlet and the inlet of the impeller. In this way, the water flow from the water outlet to the inlet of the impeller can be increased.

When the jet pump is at a low lift, that is, when a pressure at the water inlet is greater than a predetermined pressure at the inlet of the impeller, the first channel is switched on, which further increases the passing flow and effectively increases the upper limit value of the pump flow. In the case of the low lift, that is, when the pressure at the water inlet is not greater than the predetermined pressure at the inlet of the impeller, the first channel is switched off. As a result, the water flow reaching the inlet of the impeller is decreased, and the upper limit value of the pump lift is effectively increased.

When the pressure at the water inlet is less than or equal to the predetermined pressure at the inlet of the impeller, the valve core may switch off the first channel. Or, when the pressure at the water inlet is greater than the predetermined pressure at the inlet of the impeller, the valve core may move to switch on the first channel.

The present disclosure adopts an annular first channel structure. Compared with the prior art, the first channel has a larger cross-sectional area. That is, the flow of the passable fluid in the solution of the present disclosure will be larger, and correspondingly, the cavitation problem can be alleviated more excellently. Moreover, the first channel is arranged around the outer periphery of the jet tube, such that the overall volume of the entire jet pump does not increase significantly. In addition, in the present disclosure, only the valve core is arranged at the first channel, and other structures, such as a partition plate, a guide sleeve, a movable rod, a movable baffle, and a compression spring, are not involved. Therefore, compared with the prior art, the present disclosure has a simple production process and a low production cost.

In some embodiments of the present disclosure, the first channel is a straight channel. Compared with the Z-shaped flow-increasing channel in the prior art, the technology of the present disclosure conveniently avoids the occurrence of turbulent flow during the passage of the fluid. Moreover, the straight channel has a larger flow rate and high water inlet efficiency than the prior art. While in order to realize the installation of a one-way check mechanism, the flow-increasing water pump in the prior art is required to use a bent channel in the arrangement of the flow-increasing channel.

In some embodiments of the present disclosure, the cross-section of the first channel may be an annular structure. The first channel may be sleeved outside the jet tube. The valve core may be an annular structure. Preferably, the valve core is made of an elastic material. The valve core can effectively block the valve port to switch off the first channel. In the present embodiment, the structure of the valve core is similar to a sealing ring, which is a component with a simple and developed structure. Therefore, the production cost of the product is relatively low.

A side wall surface of the first channel is connected to a wall surface of the pressurizing chamber. Therefore, the fluid discharged from the jet tube will form a negative pressure at the outlet of the first channel, which drives the fluid in the first channel to be quickly discharged. In the present disclosure, since the first channel is arranged around the outer periphery of the jet tube, that is, around the nozzle in the jet pump, the fluid ejected from the nozzle will form a negative pressure at the inlet of the jet tube and the inlet of the first channel, driving the fluid to quickly enter the jet tube and the first channel. The flow-increasing channel in the prior art is arranged adjacent to a water inlet tube. Under the action of the nozzle, the fluid will reach the jet tube through the flow-increasing channel, and the fluid can easily "pass through" the flow-increasing channel. Therefore, the effect of the flow-increasing channel is not ideal, and it is possible that the one-way check mechanism cannot be switched on.

In addition, since the valve core has an annular structure, it is equivalent to that the valve core is sleeved outside the wall surface of the first channel. During movement, the valve core is limited by the wall surface of the first channel, such that the movement is stable and reliable.

In the present embodiment, both the first channel and the valve core are highly symmetrical structures, so when the fluid passes through the first channel or the fluid acts on the valve core, the forces acting on the valve core are balanced, which also makes the working state of the valve core stable and reliable.

Specifically, a valve port may be arranged on a side of the first channel adjacent to the water inlet, and the valve port may be an annular structure or include a plurality of regularly arranged rectangular, circular, or arc structures. When the structure of the valve port is arranged, the above structures can all meet the water inlet requirements of the first channel. The plurality of regularly arranged rectangular, circular, or arc structures can also realize the force balance of the valve core and the stable and reliable operation of the valve core.

In some embodiments of the present disclosure, a guide piece may be arranged on a wall surface of the first channel or the second channel adjacent to the valve port, and the valve core located in the first channel or the second channel may move to the valve port through the guide piece. In the present disclosure, the guide piece is arranged to ensure that the valve core can move to the position of the valve port stably and reliably to block the valve port.

In some embodiments of the present disclosure, a limiting piece may be arranged in the first channel or the second channel, and the valve core may be located between the valve port and the limiting piece. The limiting piece limits the movement stroke of the valve core to prevent the movement path of the valve core from exceeding the limit when the force acting on the valve core is large. When the first channel or the second channel should be blocked, it is difficult for the valve core to move to the position of the valve port.

In some embodiments of the present disclosure, a jet device may be arranged in the pump body. The jet device may include the jet tube, a water inlet tube, and the pressurizing chamber. The impeller may be arranged in the pressurizing chamber.

The water inlet tube may be connected to the water inlet. The water inlet tube may be communicated with the jet tube and the valve port of the first channel or the valve port of the second channel. The jet tube may be communicated with the water inlet tube and the inlet of the impeller. The first channel or the second channel may be communicated with the water inlet tube and the inlet of the impeller, and the inlet of the impeller may be communicated with the pressurizing chamber. The pressurizing chamber may be communicated with the water outlet of the pump body. Thus, in the present disclosure, it is realized that the fluid enters from the water inlet, passes through the water inlet tube, the jet tube, and the pressurizing chamber in sequence, and then is discharged from the water outlet of the pump body.

Whether to allow the first channel or the second channel to be switched on depends on the working state of the jet pump. If the first channel or the second channel is switched on, the fluid entering the water inlet tube will reach the pressurizing chamber through the first channel or the second channel.

In some embodiments of the present disclosure, the jet device may include a first casing, a second casing, a third casing, and a fourth casing.

The first casing and the second casing may be connected to form the water inlet tube. A part of the jet tube and an end of the valve port of the first channel or the second channel may be located in the second casing.

A part of the jet tube and a part of the first channel or second channel may be located in the third casing. The second casing and the third casing may form the jet tube, and the second casing and the third casing may form the first channel or the second channel.

The third casing and the fourth casing may form the pressurizing chamber.

In the present embodiment, the jet tube including the four parts can not only meet the general molding requirements but also facilitate the assembly of structures, such as the valve core and the impeller, which is the preferred structural arrangement of the present disclosure.

Specifically, the third casing is provided with an installation groove. The second casing is correspondingly provided with an installation portion. The installation portion is inserted into the installation groove. A sealing structure is arranged between the second casing and the third casing. Specifically, the sealing structure may be a sealing member. The second casing and the third casing can be locked by bolts.

A self-priming jet pump includes a pump body provided with a water inlet and a water outlet. A jet tube and an impeller are arranged in the pump body. The jet tube is communicated with the water inlet and an inlet of an impeller. At least two second channels are arranged on the outer periphery of the jet tube. The second channel is communicated with the water inlet and the inlet of the impeller. The fluid passing through the jet tube or the second channel is thrown out by the impeller to enter a pressurizing chamber. The second channel is provided with a valve core. The at least two second channels are arranged around the outer periphery of the jet tube. When a pressure at the water inlet is greater than a predetermined pressure at the inlet of the impeller, the valve core moves to switch on the second channel.

Compared with the prior art, the present disclosure has advantages that the at least two second channels are arranged on the outer periphery of the jet tube, and the second channels are all communicated with the water inlet and the inlet of the impeller. In this way, the water flow from the water outlet to the inlet of the impeller can be increased.

When the jet pump is at a low lift, that is, when the pressure at the water inlet is greater than the predetermined pressure at the inlet of the impeller, the second channel is switched on, which further increases the passing flow and effectively increases the upper limit value of the pump flow. In case of the low lift, that is, when the pressure at the water inlet is not greater than the predetermined pressure at the inlet of the impeller, the second channel is in a switching-off state. As a result, the water flow reaching the inlet of the impeller is decreased, and the upper limit value of the pump lift is effectively increased.

The present disclosure adopts the at least two second channels arranged around the outer periphery of the jet tube. Compared with the prior art, the at least two second channels have a larger cross-sectional area. That is, the flow of the passable fluid in the solution of the present disclosure will be larger, and correspondingly, the cavitation problem can be alleviated more excellently. Moreover, the second channels are arranged around the outer periphery of the jet tube, such that the overall volume of the entire jet pump does not increase significantly. In addition, in the present disclosure, only the valve core is arranged at the second channel, and other structures, such as a partition plate, a guide sleeve, a movable rod, a movable baffle, and a compression spring, are not involved. Therefore, compared with the prior art, the present disclosure has a simple production process and a low production cost.

In some embodiments of the present disclosure, a cross-section of the second channel may be circular or rectangular. In addition, the cross-section of the second channel may also be triangular, semicircular, and special-shaped.

In some embodiments of the present disclosure, a cross-section of the second channel may be a curved line segment, and the at least two second channels may be arranged to form an annular structure.

In some embodiments of the present disclosure, a valve port may be arranged on a side of the second channel adjacent to the water inlet. The valve core arranged in the second channel may be adapted to a structure of the valve port. When the valve core blocks the valve port, the second channel may be switched off.

Preferably, the valve port is adapted to the cross-section of the second channel, and the valve port is shaped as a circle, a rectangle, or a curved line segment. Correspondingly, the valve core is a block-shaped structural member whose cross-section is shaped as a circle, a rectangle, or a curved line segment.

Preferably, the valve core is made of an elastic material. The valve core can effectively block the valve port to switch off the second channel.

In the above embodiments, the second channel is typically a straight channel. The molding is simple and the production cost is low. Moreover, through the regular arrangement of two or more second channels, the flow change can be increased without substantially increasing the volume of the jet pump.

BRIEF DESCRIPTION OF THE DRAWINGS

The present disclosure will be further described in detail below with reference to the drawings and preferred embodiments. However, those skilled in the art should understand that these drawings are drawn only for the purpose of explaining the preferred embodiments, and therefore should not be construed as a limitation to the scope of the present disclosure. In addition, unless otherwise specified, the drawings are only intended to conceptually represent the composition or configuration of the described objects. The drawings may be exaggerated and are not necessarily drawn to scale.

Figure 1:
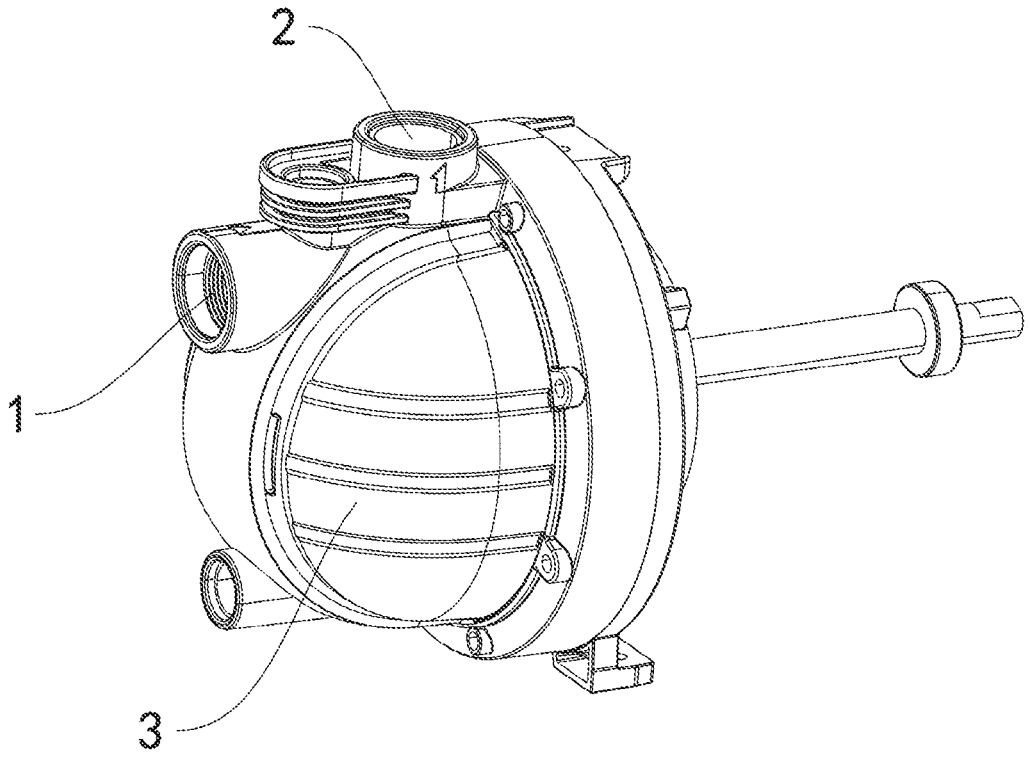
FIG. 1 is a schematic structural diagram of the self-priming jet pump of the present disclosure.

Reference Numerals: 1, water inlet; 2, water outlet; 3, pump body; 4, jet tube; 5, impeller; 6, first channel; 7, valve core; 8, valve port; 9, guide piece; and 10, limiting piece; 11, water inlet tube; 12, pressurizing chamber; 13, first casing; 14, second casing; 14*a*, installation portion; 15, third casing; 15*a*, installation groove; 16, fourth casing; and 17, guide channel.

DETAILED DESCRIPTION OF THE EMBODIMENTS

The present disclosure will be explained in detail below with reference to the drawings.

To make the objectives, technical solutions, and advantages of the present disclosure clearer, the present disclosure is further described in detail below with reference to the drawings and embodiments. It should be understood that the examples described herein are merely used to explain the present application, rather than to limit the present application.

As shown in FIG. 1 to FIG. 3 and FIG. 8, a self-priming jet pump includes a pump body 3 provided with a water inlet 1 and a water outlet 2. A jet tube 4 and an impeller 5 are arranged in the pump body 3. The jet tube 4 is communicated with the water inlet 1 and an inlet of an impeller 5. A first channel 6 is arranged on the outer periphery of the jet tube 4. The first channel 6 is communicated with the water inlet 1 and the inlet of the impeller 5. The impeller 5 is communicated with the first channel 6 and a pressurizing chamber 12, and is communicated with the jet tube 4 and the pressurizing chamber 12. The fluid passing through the jet tube or the first channel is thrown out by the impeller 5 to enter the pressurizing chamber 12. A cross-section of the first channel 6 is a closed or open annular structure. The first channel 6 is around the outer periphery of the jet tube 4. The first channel 6 is provided with a valve core 7. When the pressure at the water inlet 1 is less than or equal to a predetermined pressure at the inlet of the impeller, the valve core 7 switches off the first channel 6. Or, when the pressure at the water inlet 1 is greater than the predetermined pressure at the inlet of the impeller, the valve core 7 moves to switch on the first channel 6.

The fluid is introduced into the pump body 3 from the water inlet 1, and the first flow channel is formed by the fluid passing through the jet tube 4, the impeller 5 and the pressurizing chamber 12 in sequence to reach the water outlet 2 of the pump body 3. The second flow channel is formed by the fluid passing through the first channel 6 (in the state that the valve core 7 switches on the first channel 6), the impeller 5 and the pressurizing chamber 12 in sequence to reach the water outlet of the pump body 3.

The first channel 6 is arranged on the outer periphery of the jet tube 4, and the first channel 6 is communicated with the water inlet 1 and the inlet of the impeller 5. In this way, the water flow from the water outlet 2 to the inlet of the impeller 5 can be increased. Correspondingly, the cavitation problem can be alleviated more excellently. Moreover, the first channel 6 is arranged around the outer periphery of the jet tube 4, such that the overall volume of the entire jet pump does not increase significantly. In addition, in the present disclosure, only the valve core 7 is arranged at the first channel 6, and other structures, such as a partition plate, a guide sleeve, a movable rod, a movable baffle, and a compression spring, are not involved. Therefore, compared with the prior art, the present disclosure has a simple production process and a low production cost.

In the present disclosure, when the jet pump is at a low lift, that is, when the pressure at the water inlet 1 is greater than the predetermined pressure at the inlet of the impeller 5, the first channel 6 is switched on, which further increases the passing flow and effectively increases the upper limit value of the pump flow. In the case of the low lift, that is, when the pressure at the water inlet 1 is not greater than the predetermined pressure at the inlet of the impeller 5, the first channel 6 is switched off. As a result, the purpose of decreasing the water flow at the inlet of the impeller 5 is realized.

Figure 2:
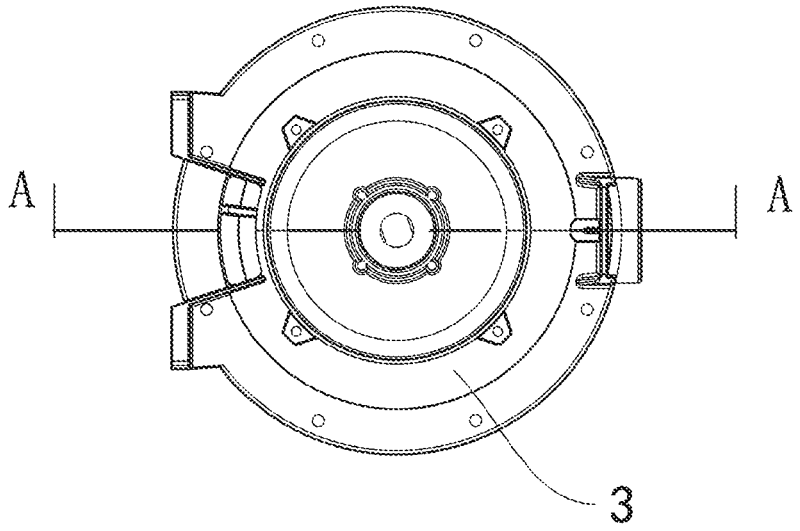
FIG. 2 is a side view of the self-priming jet pump of the present disclosure.
Figure 3:
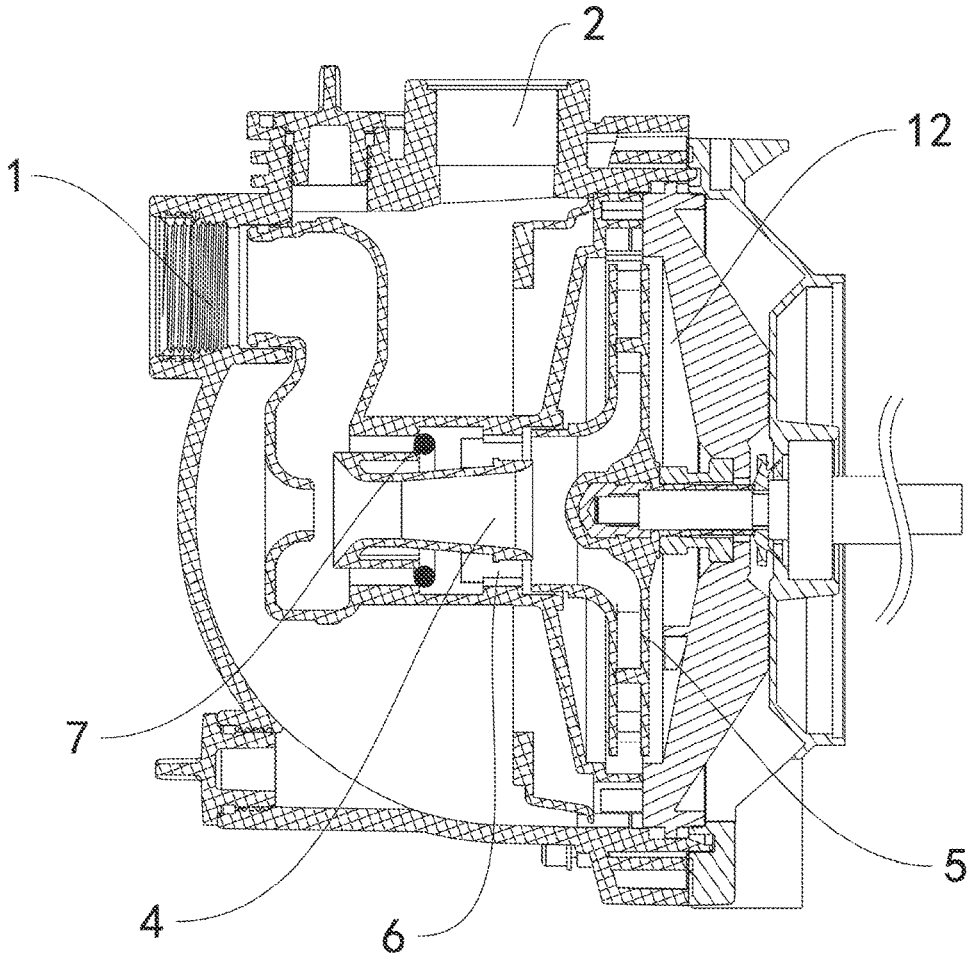
FIG. 3 is a sectional view taken along a cross-section A-A of FIG. 2.
Figure 4:
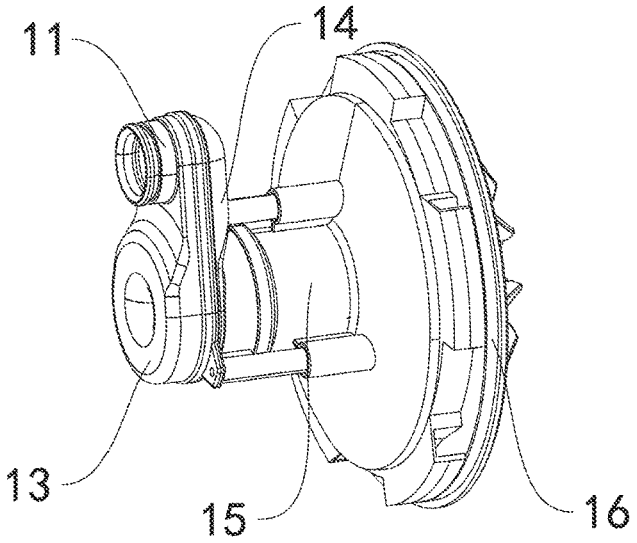
FIG. 4 is a schematic structural diagram of a jet device.
Figure 5:
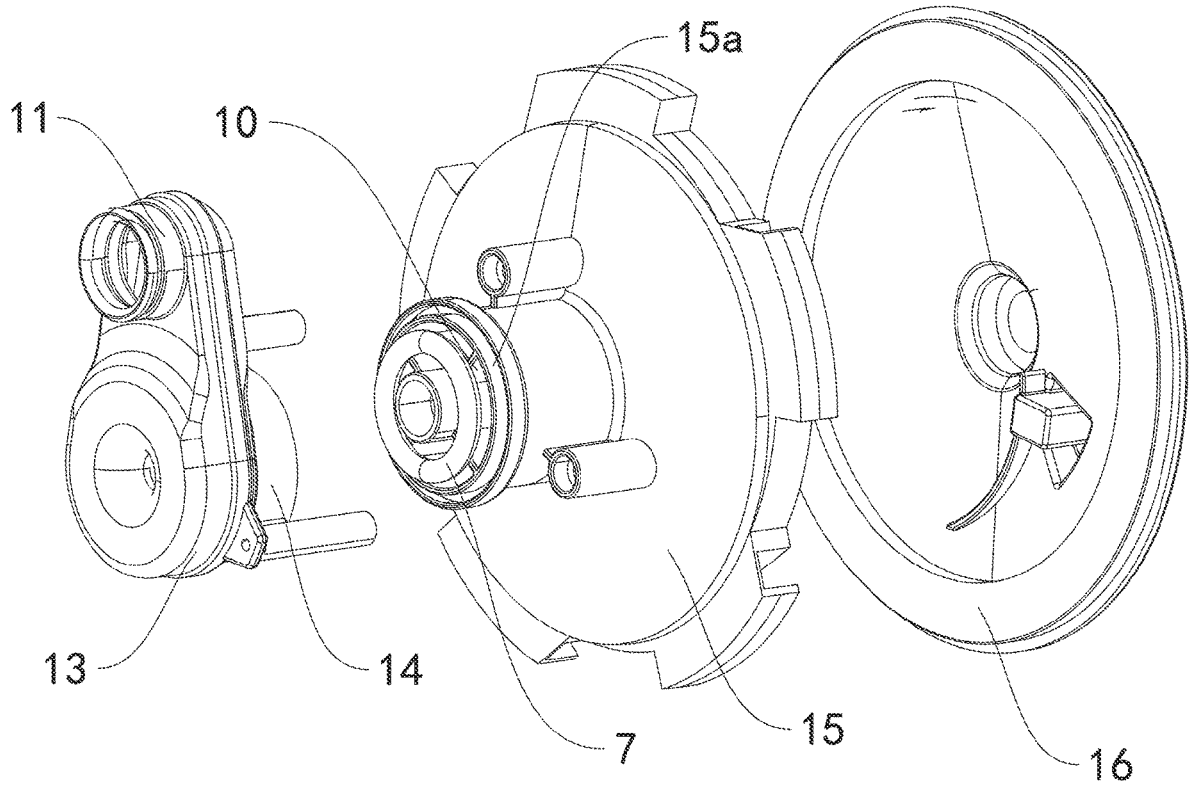
FIG. 5 is an exploded schematic structural diagram of the jet device.
Figure 6:
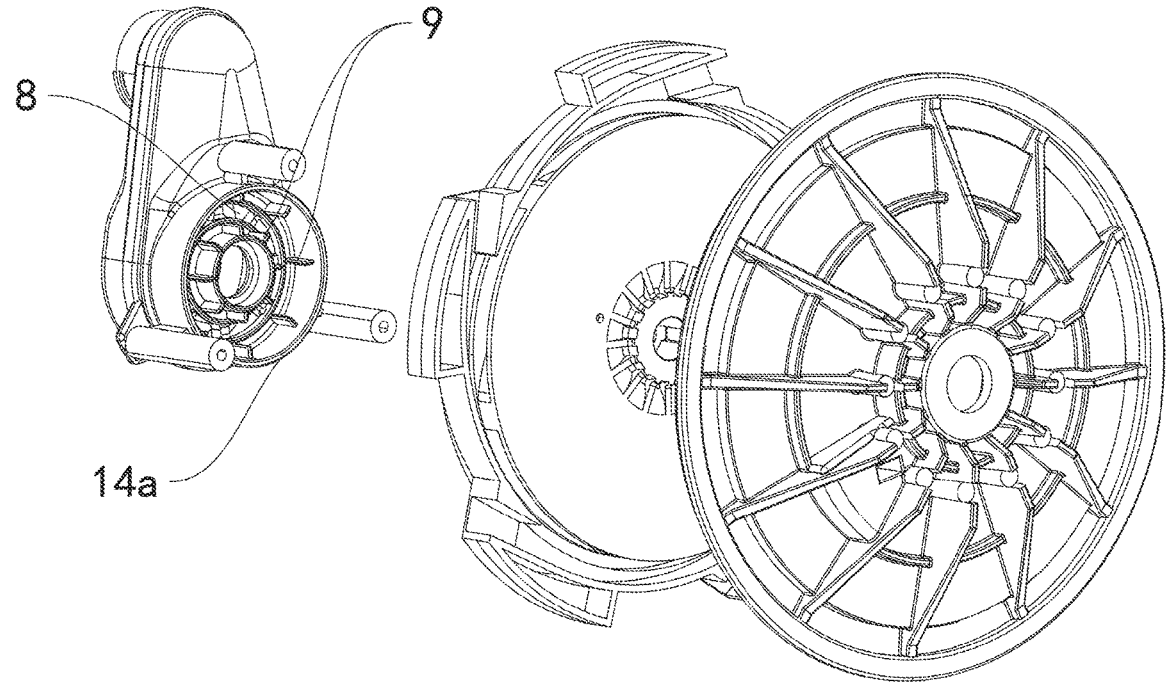
FIG. 6 is an exploded schematic structural diagram of the jet device in a different perspective from FIG. 5.

As shown in FIG. 1 to FIG. 3, the cross-section of the first channel 6 is an annular structure. The first channel 6 is sleeved outside the jet tube 4. The valve core is an annular structure.

A valve port 8 is arranged on a side of the first channel 6 adjacent to the water inlet 1, and the valve port 8 is an annular structure or includes a plurality of regularly arranged rectangular, circular, or arc structures. When the structure of the valve port 8 is arranged, the above structures can all meet the water inlet requirements of the first channel 6. The plurality of regularly arranged rectangular, circular, or arc structures can also realize the force balance of the valve core 7 and realize the stable and reliable operation of the valve core 7.

Preferably, the valve core 7 is made of an elastic material. The valve core 7 can effectively block the valve port 8 to switch off the first channel 6. In the present embodiment, the structure of the valve core is similar to a sealing ring, which is a component with a simple and developed structure. Therefore, the production cost of the product is relatively low.

In addition, since the valve core 7 has an annular structure, it is equivalent to that the valve core 7 is sleeved outside the wall surface of the first channel 6. During movement, the valve core 7 is limited by the wall surface of the first channel 6, such that the movement is stable and reliable.

In the present embodiment, both the first channel 6 and the valve core 7 are highly symmetrical structures, so when the fluid passes through the first channel 6 or the fluid acts on the valve core 7, the forces acting on the valve core 7 are balanced, which also makes the working state of the valve core 7 stable and reliable.

As shown in FIG. 3 to FIG. 6, a guide piece 9 is arranged on a wall surface of the first channel 6 or the second channel adjacent to the valve port 8, and the valve core 7 located in the first channel 6 or the second channel moves to the valve port 8 through the guide piece 9. In the present disclosure, the guide piece 9 is arranged to ensure that the valve core 7 can move to the position of the valve port 8 stably and reliably to block the valve port 8.

A limiting piece 10 is arranged in the first channel 6 or the second channel, and the valve core 7 is located between the valve port 8 and the limiting piece 10. The limiting piece 10 limits the movement stroke of the valve core 7 to prevent the movement path of the valve core 7 from exceeding the limit when the force acting on the valve core 7 is large. When the first channel 6 or the second channel should be blocked, it is difficult for the valve core 7 to move to the position of the valve port 8.

As shown in FIG. 3 to FIG. 6, a jet device is arranged in the pump body 3. The jet device includes the jet tube 4, a water inlet tube 11, and the pressurizing chamber 12. The impeller 5 is arranged in the pressurizing chamber 12.

The water inlet tube 11 is connected to the water inlet. The water inlet tube 11 is communicated with the jet tube 4 and the valve port 8 of the first channel 6 or the valve port 8 of the second channel. The jet tube 4 is communicated with the water inlet tube 11 and the water inlet of the impeller 5. The first channel 6 or the second channel is communicated with the water inlet tube 11 and the water inlet of the impeller 5. The water outlet of the pressurizing chamber 12 is communicated with the water outlet 2 of the pump body 3. Thus, in the present disclosure, it is realized that the fluid enters from the water inlet, passes through the water inlet tube 11, the jet tube 4, the impeller 5, and the pressurizing chamber 12 in sequence, and then is discharged from the water outlet 2 of the pump body 3.

Whether to allow the first channel 6 or the second channel to be switched on depends on the working state of the jet pump. If the first channel 6 or the second channel is switched on, the fluid entering the water inlet tube 11 will reach the pressurizing chamber 12 through the first channel 6 or the second channel and the impeller 5.

The jet device includes a first casing 13, a second casing 14, a third casing 15, and a fourth casing 16.

The first casing 13 and the second casing 14 are connected to form the water inlet tube 11. A part of the jet tube 4 and an end of the valve port 8 of the first channel 6 or the second channel are located in the second casing 14.

A part of the jet tube 4 and a part of the first channel 6 or second channel are located in the third casing 15. The second casing 14 and the third casing 15 form the jet tube 4, and the second casing 14 and the third casing 15 form the first channel 6 or the second channel.

The third casing 15 and the fourth casing 16 form the pressurizing chamber 12.

In the present embodiment, the jet tube 4 including the four parts can not only meet the general molding requirements but also facilitate the assembly of structures, such as the valve core 7 and the impeller 5, which is the preferred structural arrangement of the present disclosure.

Specifically, the third casing 15 is provided with an installation groove 15*a*. The second casing 14 is correspondingly provided with an installation portion 14*a*. The installation portion 14*a* is inserted into the installation groove 15*a*. A sealing structure is arranged between the second casing 14 and the third casing 15. Specifically, the sealing structure may be a sealing member. The second casing 14 and the third casing 15 can be locked by bolts.

Figure 7:
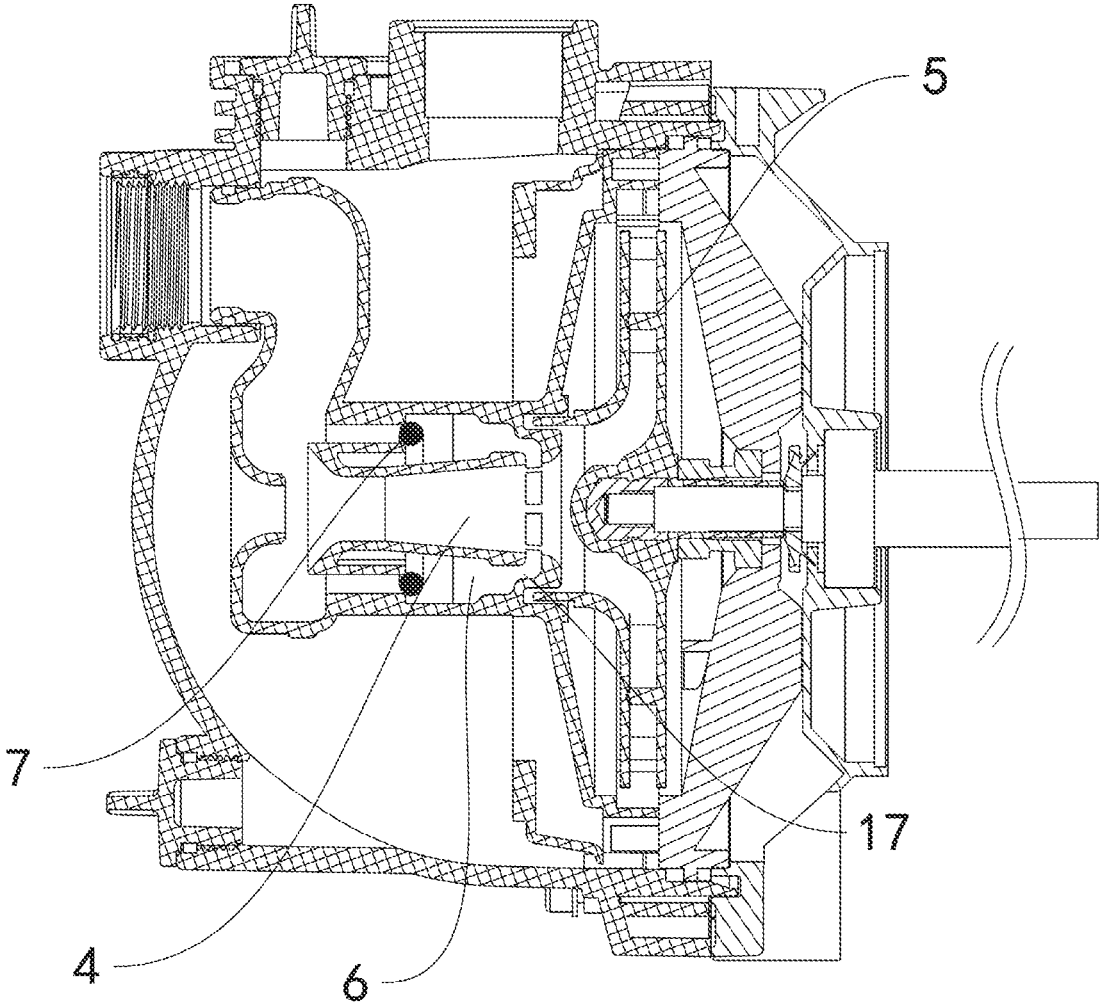
FIG. 7 is a sectional view of an alternative embodiment of a sectional view taken along a cross-section A-A of FIG. 2 of the present disclosure.
Figure 8:
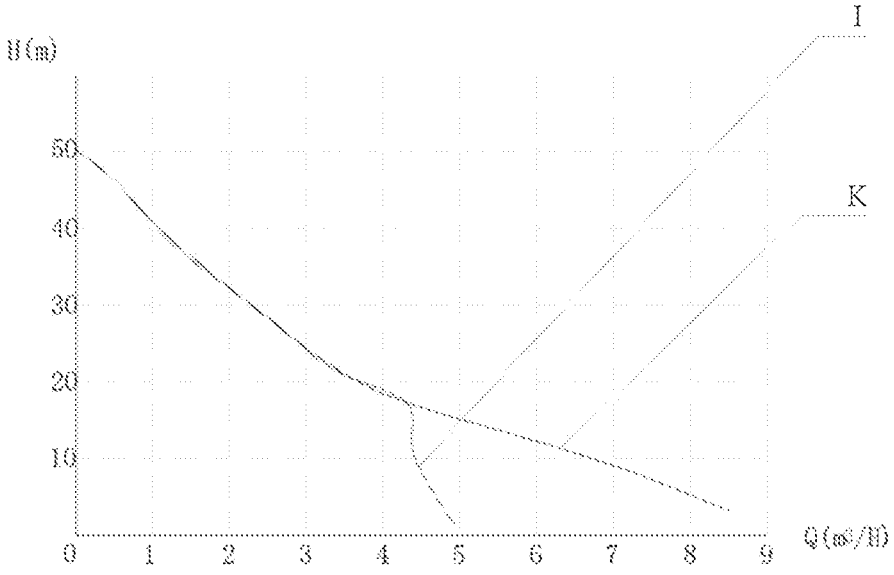
FIG. 8 is a performance comparison graph of the self-priming jet pump in the prior art and the self-priming jet pump of the present disclosure, where curve I is a performance curve of the self-priming jet pump in the prior art, and curve K is a performance curve of the self-priming jet pump of the present disclosure.

As shown in FIG. 7, which is a an alternative embodiment from what is shown in FIG. 3, a section of the first channel 6 or second channel adjacent to the impeller 5 is denoted as a guide channel 17, and the guide channel 17 is a curved channel. A guide port of the guide channel 17 is formed at a wall surface of the jet tube 4 adjacent to the impeller 5. With the above-mentioned structural arrangement of the guide channel 17, the fluid discharged from the first channel 6 or the second channel has more jet efficiency.

Specifically, the guide port of the guide channel 17 is located at a diffusion section of the jet tube 4. The fluid passing through the first channel 6 or the second channel will enter the jet tube 4 and is guided to the inlet of the impeller 5 together with the fluid passing through the jet tube 4 to further enter the pressurizing chamber 12. Since the guide port is formed at the diffusion section of the jet tube 4, the fluid discharged from the first channel 6 or the second channel has little influence on the fluid in the jet tube 4. This also avoids the influence of increasing turbulence on the fluid in the first channel 6 or the second channel during the high-speed jet of the jet device.

Preferably, a longitudinal section of the outer side wall surface of the guide channel 17 is a multi-step stepped surface. The fluid passes through the guide channel 17 to form a certain buffer on the outer wall surface of the guide channel 17. In this way, the influence on the fluid in the jet tube 4 due to the impact of the fluid at the guide port is avoided.

A self-priming jet pump includes a pump body 3 provided with a water inlet 1 and a water outlet 2. A jet tube 4 and an impeller 5 are arranged in the pump body 3. The jet tube 4 is communicated with the water inlet 1 and a water inlet of an impeller 5. At least two second channels are arranged on the outer periphery of the jet tube 4. The second channel is communicated with the water inlet 1 and the water inlet of the impeller 5. The fluid passing through the jet tube 4 or the second channel is thrown out by the impeller 5 to enter a pressurizing chamber 12. The second channel is provided with a valve core 7. The at least two second channels are arranged around the outer periphery of the jet tube 4. When a pressure at the water inlet 1 is greater than a predetermined pressure at the water inlet of the impeller 5, the valve core 7 moves to switch on the second channel.

The fluid is introduced into the pump body 3 from the water inlet 1, and the first flow channel is formed by the fluid passing through the jet tube 4, the impeller 5 and the pressurizing chamber 12 in sequence to reach the water outlet 2 of the pump body 3. The second flow channel is formed by the fluid passing through the second channel (in the state that the valve core switches on the second channel), the impeller 5 and the pressurizing chamber 12 in sequence to reach the water outlet of the pump body 3.

The at least two second channels are arranged on the outer periphery of the jet tube 4, and the second channels are all communicated with the water inlet 1 and the water inlet of the impeller 5. In this way, the water flow from the water outlet 2 to the water inlet of the impeller 5 can be increased. Correspondingly, the cavitation problem can be alleviated more excellently. Moreover, the second channels are arranged around the outer periphery of the jet tube 4, such that the overall volume of the entire jet pump does not increase significantly. In addition, in the present disclosure, only the valve core 7 is arranged at the second channel, and other structures, such as a partition plate, a guide sleeve, a movable rod, a movable baffle, and a compression spring, are not involved. Therefore, compared with the prior art, the present disclosure has a simple production process and a low production cost.

In the present disclosure, when the jet pump is at a low lift, that is, when the pressure at the water inlet 1 is greater than the predetermined pressure at the water inlet of the impeller 5, the second channel is switched on, which further increases the passing flow and effectively increases the upper limit value of the pump flow. In case of the low lift, that is, when the pressure at the water inlet 1 is not greater than the predetermined pressure at the water inlet of the impeller 5, the second channel is in a switching-off state. As a result, the purpose of decreasing the water flow at the water inlet of the impeller 5 is realized, and the upper limit value of the pump lift is effectively increased.

The cross-section of the second channel is circular or rectangular.

The cross-section of the second channel is a curved line segment, and the at least two second channels are arranged to form an annular structure.

A valve port 8 is arranged on a side of the second channel adjacent to the water inlet 1. The valve core 7 arranged in the second channel is adapted to a structure of the valve port 8. When the valve core 7 blocks the valve port 8, the second channel is switched off. Preferably, the valve port 8 is adapted to the cross-section of the second channel, and the valve port 8 is shaped as a circle, a rectangle, or a curved line segment. Correspondingly, the valve core 7 is a block-shaped structural member whose cross-section is shaped as a circle, a rectangle, or a curved line segment. Preferably, the valve core 7 is made of an elastic material. The valve core 7 can effectively block the valve port 8 to switch off the second channel.

In the above embodiments, the second channel is typically a straight channel. The molding is simple and the production cost is low. Moreover, through the regular arrangement of two or more second channels, the flow change can be increased without substantially increasing the volume of the jet pump 3.

The present disclosure is described in detail above. Specific examples are used herein to illustrate the principles and implementation of the present disclosure, and the description of the above embodiments is only intended to help understand the present disclosure and the core idea thereof. It should be noted that several improvements and modifications may also be made by those having ordinary skill in the art without departing from the principles of the present disclosure, which should also fall within the scope of protection of the present disclosure.

What is claimed is:

1. A self-priming jet pump, comprising a pump body provided with a water inlet and a water outlet;

wherein a jet tube and an impeller are arranged in the pump body, the jet tube is communicated with the water inlet and an inlet of the impeller, a channel is arranged on an outer periphery of the jet tube, the channel is in communication with the water inlet and the inlet of the impeller, a fluid passing through the jet tube or the channel is thrown out by the impeller to enter a pressurizing chamber, a cross-section of the channel is an annular structure, the channel is around the outer periphery of the jet tube, and the channel is provided with a valve core;

wherein an inner wall of the jet tube is imperforate extending from an inlet end of the jet tube through a narrowest constriction point of the jet tube.

2. The self-priming jet pump according to claim 1, wherein when a pressure at the water inlet is less than or equal to a predetermined pressure at the inlet of the impeller, the valve core switches off the channel; or, when the pressure at the water inlet is greater than the predetermined pressure at the inlet of the impeller, the valve core moves to switch on the channel.

3. The self-priming jet pump according to claim 1, wherein the cross-section of the channel is a first annular structure, the channel is a straight channel, the channel is sleeved outside the jet tube, and the valve core is a second annular structure.

4. The self-priming jet pump according to claim 3, wherein a valve port is arranged on a side of the channel adjacent to the water inlet, and the valve port is a third annular structure or comprises a plurality of regularly arranged rectangular, circular, or arc structures.

5. The self-priming jet pump according to claim 3, wherein a guide piece is arranged on a wall surface of the channel adjacent to a valve port, and the valve core located in the channel moves to the valve port through the guide piece.

6. The self-priming jet pump according to claim 3, wherein a limiter is arranged in the channel, and the valve core is located between a valve port and the limiter.

7. The self-priming jet pump according to claim 1, wherein a jet device is arranged in the pump body, and the jet device comprises the jet tube, a water inlet tube, and the inlet of the impeller, wherein the impeller is arranged in the pressurizing chamber;

the water inlet tube is connected to the water inlet, the water inlet tube is in communication with the jet tube and a valve port of the channel, the jet tube is in communication with the water inlet tube and the inlet of the impeller, the channel is in communication with the water inlet tube and the inlet of the impeller, and the inlet of the impeller is in communication with the water outlet of the pump body.

8. The self-priming jet pump according to claim 7, wherein the jet device comprises a first casing, a second casing, a third casing, and a fourth casing;

wherein the first casing and the second casing form the water inlet tube, and a first part of the jet tube and an end of the valve port of the channel are located in the second casing;

a second part of the jet tube and a part of the channel are located in the third casing, the second casing and the third casing form the jet tube, and the second casing and the third casing form the channel; and the third casing and the fourth casing form pressurizing chamber.

9. The self-priming jet pump according to claim 1, wherein a section of the channel adjacent to the impeller defines a guide channel, and the guide channel is curved between an inlet flow parallel to a major axis of the jet pump and an outflow perpendicular to the major axis of the jet pump; and a guide port of the guide channel is formed at an outer wall surface of the jet tube adjacent to the impeller.

10. A self-priming jet pump, comprising:

a pump body provided with a water inlet and a water outlet, wherein a jet tube and an impeller are arranged in the pump body, the jet tube is in communication with the water inlet and an inlet of the impeller, a channel is arranged on an outer periphery of the jet tube, the channel is communicated with the water inlet and the inlet of the impeller, a fluid passing through the jet tube or the channel is thrown out by the impeller to enter a pressurizing chamber, the channel is arranged around the outer periphery of the jet tube, and the channel is provided with a valve core;

wherein a jet device is arranged in the pump body, and the jet device comprises the jet tube, a water inlet tube, and the pressurizing chamber, wherein the impeller is arranged in the pressurizing chamber;

the water inlet tube is connected to the water inlet, the water inlet tube is in communication with the jet tube and a valve port of the channel;

the jet tube is in communication with the water inlet tube and the inlet of the impeller;

the channel is in communication with the water inlet tube and the inlet of the impeller; and the pressurizing chamber is in communication with the water outlet of the pump body, wherein a cross-section of the channel is circular or rectangular, and wherein a section of the channel adjacent to the impeller forms a guide channel, and a longitudinal section of the outer side wall surface of the guide channel is a multi-stepped surface, and a guide port of the guide channel is formed at an outer wall surface of the jet tube adjacent to the impeller.

* * * * *